US008144113B2

(12) United States Patent
Park et al.

(10) Patent No.: US 8,144,113 B2
(45) **Date of Patent: *Mar. 27, 2012**

(54) LIQUID CRYSTAL DISPLAY

(75) Inventors: Joon Kyu Park, Gyeonggi-do (KR); Jong Hoon Kim, Gyeonggi-do (KR)

(73) Assignee: LG Display Co., Ltd., Seoul (KR)

( * ) Notice: Subject to any disclaimer, the term of this patent is extended or adjusted under 35 U.S.C. 154(b) by 532 days.

This patent is subject to a terminal disclaimer.

(21) Appl. No.: 12/314,806

(22) Filed: Dec. 17, 2008

(65) Prior Publication Data

US 2010/0066657 A1 Mar. 18, 2010

(30) Foreign Application Priority Data

Apr. 16, 2008 (KR) ..... 10-2008-0035158

(51) Int. Cl.
*G09G 3/36* (2006.01)

(52) U.S. Cl. ..... 345/102; 345/76; 345/82; 345/89; 345/204; 345/690; 362/97.2; 362/97.3; 349/61; 349/69

(58) Field of Classification Search ..... 345/82, 345/76, 102, 88–89, 94, 204, 690–691; 349/61, 349/69; 362/97.1–97.3
See application file for complete search history.

(56) References Cited

U.S. PATENT DOCUMENTS 7,505,016 B2 * 3/2009 Kwon ..... 345/87
2006/0256224 A1 * 11/2006 Kitaura ..... 348/333.01
2007/0152926 A1 * 7/2007 Kwon ..... 345/82
2008/0024517 A1 * 1/2008 Kerofsky ..... 345/600
2009/0140665 A1 * 6/2009 Park ..... 315/291

FOREIGN PATENT DOCUMENTS

CN 1991967 7/2007
CN 101038719 9/2007

* cited by examiner

*Primary Examiner* — Lun-Yi Lao
*Assistant Examiner* — Md Saiful A Siddiqui
(74) *Attorney, Agent, or Firm* — Morgan, Lewis & Bockius LLP

(57) ABSTRACT

Disclosed herein is a liquid crystal display capable of reducing a side effect during local LED dimming to reduce power consumption and improve display quality. The liquid crystal display includes a liquid crystal panel having a plurality of liquid crystal cells formed respectively in a plurality of pixel areas defined by intersections of a plurality of gate lines and a plurality of data lines, a data driver for supplying data voltages to the data lines, a gate driver for supplying scan signals to the gate lines, a timing controller for controlling the data driver and gate driver and outputting a plurality of dimming signals based on an average picture level (APL) detected based on video data supplied to the liquid crystal panel, and a light emitting diode (LED) backlight unit for partitioning the liquid crystal panel into a plurality of areas and supplying appropriate pulse width modulation (PWM) control signals based on the dimming signals to a plurality of LED arrays installed to correspond respectively to the partitioned areas, to supply light to the liquid crystal panel.

4 Claims, 6 Drawing Sheets

The Related Art

The Related Art

LIQUID CRYSTAL DISPLAY

This application claims the benefit of the Korean Patent Application No. P2008-035158, filed on Apr. 16, 2008, which is hereby incorporated by reference as if fully set forth herein.

BACKGROUND OF THE INVENTION

1. Field of the Invention

The present invention relates to a liquid crystal display, and more particularly, to a liquid crystal display which is capable of reducing power consumption and improving display quality.

2. Discussion of the Related Art

Recently, various flat panel display devices have been developed to reduce weight and volume which are disadvantages of a cathode ray tube. These flat panel display devices may be, for example, a liquid crystal display, a field emission display, a plasma display panel, a light emitting device, and the like.

The liquid crystal display, among the flat panel display devices, includes a liquid crystal panel including a plurality of liquid crystal cells arranged in matrix form and a plurality of control switches for switching video signals to be supplied respectively to the liquid crystal cells, and a backlight unit for supplying light to the liquid crystal panel. The liquid crystal panel is adapted to control transmittance of the light supplied from the backlight unit to display a desired image on a screen.

Recently, backlight units have become smaller, thinner and lighter. According to this trend, there have been proposed backlight units using light emitting diodes (referred to hereinafter as LEDs) which are advantageous in terms of power consumption, weight, brightness, etc., instead of fluorescent lamps.

FIG. 1 schematically shows the configuration of a liquid crystal display of the related art using an LED backlight unit.

Referring to FIG. 1, the conventional liquid crystal display comprises a liquid crystal panel 2 having liquid crystal cells formed respectively in areas defined by n gate lines GL1 to GLn and m data lines DL1 to DLm, a data driver 4 for supplying analog video signals to the data lines DL1 to DLm, a gate driver 6 for supplying scan signals to the gate lines GL1 to GLn, a timing controller 8 for controlling the data driver 4 and gate driver 6 and generating a dimming signal DS using input data RGB, and an LED backlight unit 10 for turning on a plurality of LEDs in response to the dimming signal DS to irradiate light to the liquid crystal panel 2.

The liquid crystal panel 2 includes a transistor array substrate and a color filter array substrate bonded to face each other, a spacer for keeping a cell gap between the two array substrates constant, and a liquid crystal filled in a liquid crystal space provided by the spacer.

The liquid crystal panel 2 further includes thin film transistors (TFTs) formed respectively in the areas defined by the n gate lines GL1 to GLn and the m data lines DL1 to DLm, and liquid crystal cells connected respectively to the TFTs. Each TFT supplies an analog video signal from a corresponding one of the data lines DL1 to DLm to a corresponding one of the liquid crystal cells in response to a scan signal from a corresponding one of the gate lines GL1 to GLn. Each liquid crystal cell can be equivalently expressed as a liquid crystal capacitor Clc because it is provided with a pixel electrode connected to the corresponding TFT, and a common electrode facing the pixel electrode with a liquid crystal interposed therebetween. This liquid crystal cell further includes a storage capacitor Cst for maintaining an analog video signal charged on the liquid crystal capacitor Clc until a next analog video signal is charged thereon.

The timing controller 8 arranges data RGB externally inputted thereto suitably for the driving of the liquid crystal panel 2 and supplies the arranged data to the data driver 4. Also, the timing controller 8 generates data control signals DCS and gate control signals GCS using a dot clock DCLK, a data enable signal DE, and horizontal and vertical synchronous signals Hsync and Vsync externally inputted thereto, and applies the generated data control signals DCS and gate control signals GCS to the data driver 4 and gate driver 6, respectively, to control the driving timings thereof.

The timing controller 8 also generates a dimming signal DS for control of the LED backlight unit 10 using the input data RGB.

The gate driver 6 includes a shift register for sequentially generating scan signals, or gate high signals, in response to the gate control signals GCS from the timing controller 8. This gate driver 6 sequentially supplies the gate high signals to the gate lines GL of the liquid crystal panel 2 to turn on the TFTs connected to the gate lines GL.

The data driver 4 converts data signals Data supplied from the timing controller 8 into analog video signals in response to the data control signals DCS from the timing controller 8 and supplies analog video signals of one horizontal line to the data lines DL at intervals of one horizontal period in which each scan signal is supplied to each gate line GL. That is, the data driver 4 selects gamma voltages having certain levels based on gray scale values of the data signals Data and supplies the selected gamma voltages to the data lines DL1 to DLm. At this time, the data driver 4 inverts the polarities of the analog video signals to be supplied to the data lines DL1 to DLm in response to a polarity control signal POL.

The LED backlight unit 10 includes an LED array 12 including a plurality of LEDs, and an LED controller 14 for turning on the LEDs in response to the dimming signal DS from the timing controller 8.

The LED controller 14 generates a pulse width modulation (PWM) control signal Vpwm corresponding to the dimming signal DS and supplies the generated PWM control signal Vpwm to the LED array 12.

The LED array 12 is disposed to face the rear surface of the liquid crystal panel 2, and includes a plurality of red, green and blue LEDs arranged repetitively.

Each LED is turned on in response to the PWM control signal Vpwm supplied from the LED controller 14 to emit light to the liquid crystal panel 2.

This liquid crystal display of the related art using the LED backlight unit converts input data RGB into analog video signals and supplies the converted video signals to the respective data lines DL synchronously with the supply of a scan signal to each gate line GL to drive the liquid crystal cells. Also, the liquid crystal display turns on a plurality of LEDs with a PWM control signal Vpwm corresponding to a dimming signal DS based on the input data RGB from one predetermined dimming curve to irradiate light to the liquid crystal cells. Therefore, the liquid crystal display controls transmittance of light irradiated from the LED backlight unit 10 through the liquid crystal cells driven by the analog video signals to display an image corresponding to the input data on the liquid crystal panel 2.

However, the liquid crystal display using the LED backlight unit is disadvantageous in that it cannot partially emphasize the brightness of an image displayed on the liquid crystal panel 2 using the LED backlight unit because it generates the dimming signal DS based on the input data RGB from one predetermined dimming curve.

In other words, in the case where the input data has a high average picture level (referred to hereinafter as an APL) as in a dimming curve REF1 having an abrupt gray level variation, as shown in FIG. 2, an image outputted to the liquid crystal panel is mostly present in a bright area. In this case, when the dimming signal is supplied to the LED backlight unit using any one of the dimming curve REF1 or dimming curve REF2, the LED backlight unit may scarcely dim, resulting in a reduction in power consumption reducing effect. Particularly, in the case where the dimming signal is based on the dimming curve REF2 having a slow gray level variation, a side effect such as darkening or flashing of the screen may occur depending on the APL.

SUMMARY OF THE INVENTION

Accordingly, the present invention is directed to a liquid crystal display that substantially obviates one or more problems due to limitations and disadvantages of the related art.

An object of the present invention is to provide a liquid crystal display which is capable of supplying an optimum dimming signal based on an average picture level of input video data to an LED backlight unit, so as to reduce power consumption and improve display quality.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a liquid crystal display includes: a liquid crystal panel having a plurality of liquid crystal cells formed respectively in a plurality of pixel areas defined by intersections of a plurality of gate lines and a plurality of data lines; a data driver for supplying data voltages to the data lines; a gate driver for supplying scan signals to the gate lines; a timing controller for controlling the data driver and gate driver and outputting a plurality of dimming signals based on an average picture level (APL) detected based on video data supplied to the liquid crystal panel; and a light emitting diode (LED) backlight unit for partitioning the liquid crystal panel into a plurality of areas and supplying appropriate pulse width modulation (PWM) control signals based on the dimming signals to a plurality of LED arrays installed to correspond respectively to the partitioned areas, to supply light to the liquid crystal panel.

The timing controller may include: a data processor for arranging the video data and supplying the arranged data to the data driver; a control signal generator for generating data and gate control signals for control of the data driver and gate driver; and an LED dimming signal generator for generating the plurality of dimming signals appropriate respectively to the plurality of areas.

The LED dimming signal generator may include: a total APL detector for detecting a total APL of the video data; an APL-by-area detector for detecting APLs-by-areas of the video data supplied to the plurality of areas; and a plurality of lookup tables each for storing dimming values set according to the total APL detected by the total APL detector and the APLs-by-areas detected by the APL-by-area detector and outputting the stored dimming values as the dimming signals.

Each of the lookup tables may store dimming values measured with respect to a maximum APL and minimum APL of the video data and APLs between the maximum APL and minimum APL.

The LED dimming signal generator may further include a filter for removing noise from the dimming signals from the lookup tables.

The LED backlight unit may include: the plurality of LED arrays each including a plurality of LEDs corresponding to a corresponding one of the plurality of areas; and an LED controller for outputting the control signals to the plurality of LED arrays, respectively, in response to the plurality of dimming signals to turn on the LED arrays.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the preferred embodiments of the present invention, examples of which are illustrated in the accompanying drawings. Wherever possible, the same reference numbers will be used throughout the drawings to refer to the same or like parts.

Figure 1:
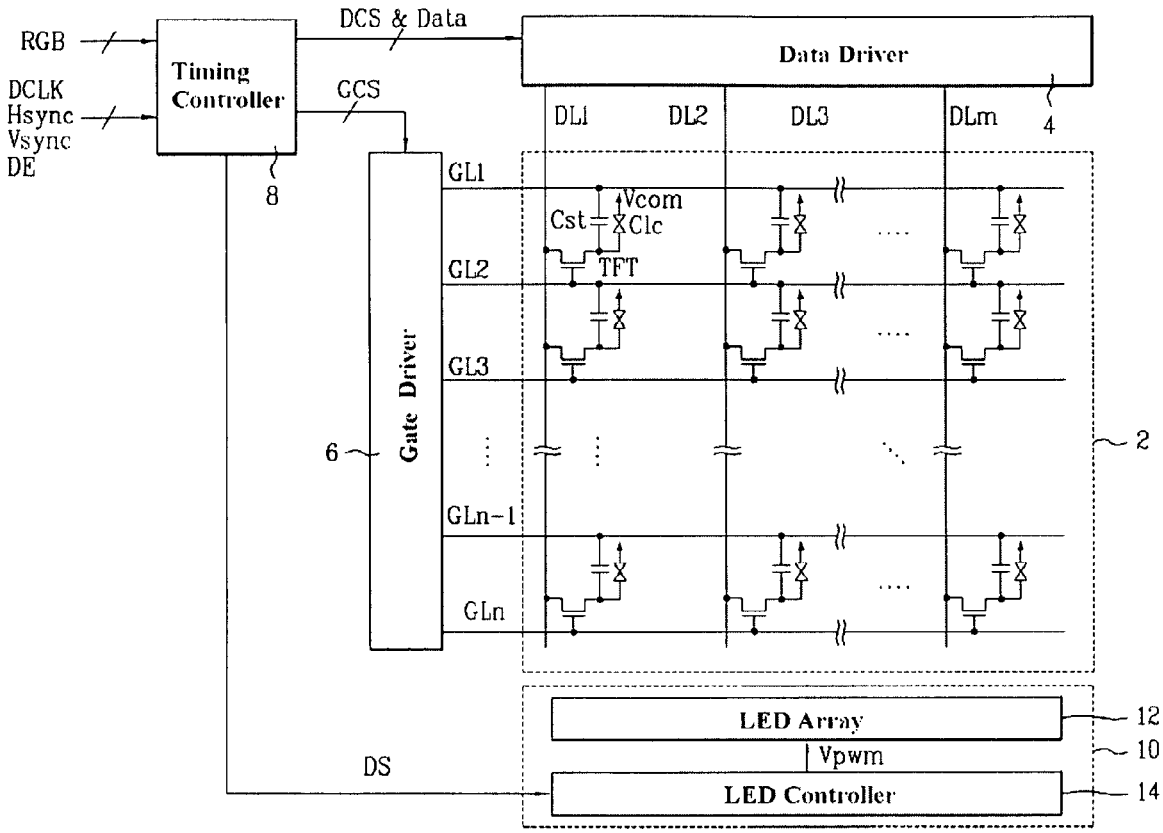
FIG. 1 is a schematic view of a conventional liquid crystal display.
Figure 2:
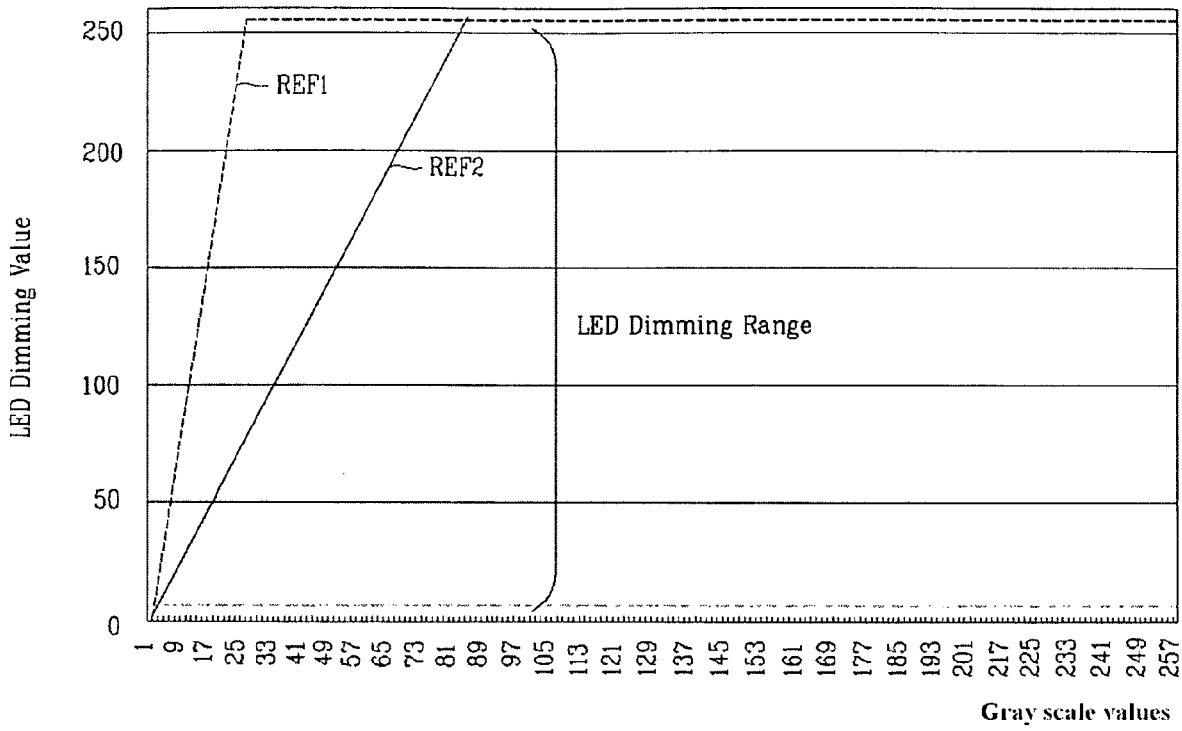
FIG. 2 is a view showing a conventional dimming curve based on an APL.
Figure 3:
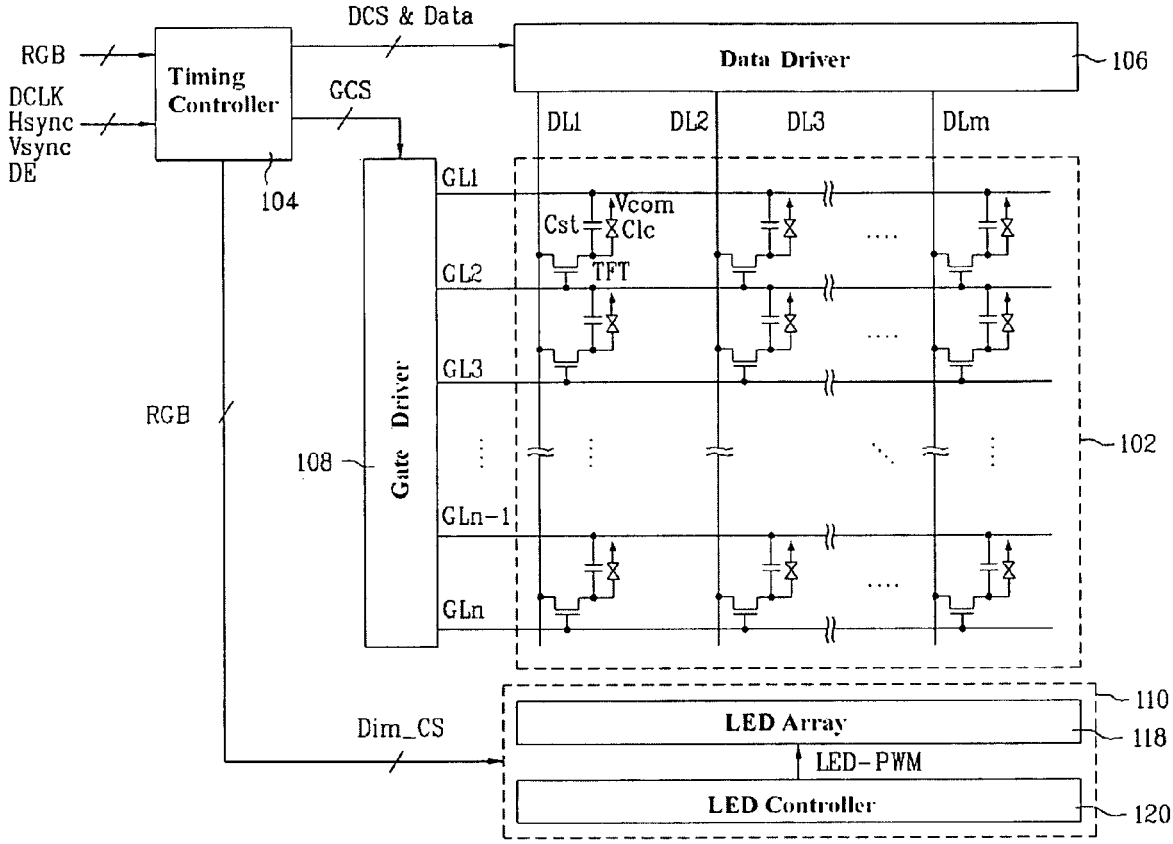
FIG. 3 is a schematic view of a liquid crystal display according to an embodiment of the present invention.

FIG. 3 is a schematic view of a liquid crystal display according to an embodiment of the present invention.

Referring to FIG. 3, the liquid crystal display according to the present embodiment comprises a liquid crystal panel 102 having a plurality of liquid crystal cells formed respectively in a plurality of pixel areas defined by intersections of a plurality of gate lines GL1 to GLn and a plurality of data lines DL1 to DLm, a data driver 106 for supplying data voltages to the data lines DL, a gate driver 108 for supplying scan signals to the gate lines GL, a timing controller 104 for controlling the data driver 106 and gate driver 108 and outputting a plurality of dimming signals Dim_CS based on an average picture level (APL) detected based on video data supplied to the liquid crystal panel 102, and an LED backlight unit 110 for partitioning the liquid crystal panel 102 into a plurality of areas and supplying appropriate PWM control signals LED_PWM based on the dimming signals Dim_CS to a plurality of LED arrays 118 installed to correspond respectively to the partitioned areas, to supply light to the liquid crystal panel 102.

The liquid crystal panel 102 includes a lower substrate and an upper substrate bonded to face each other. Provided between the lower substrate and the upper substrate are a spacer (not shown) for keeping a cell gap between the two substrates constant, and a liquid crystal layer (not shown).

The lower substrate includes a plurality of data lines DL1 to DLm and a plurality of gate lines GL1 to GLn arranged to intersect each other, a plurality of thin film transistors (TFTs) formed respectively in liquid crystal cell areas defined by the intersections of the data lines DL1 to DLm and the gate lines GL1 to GLn, and pixel electrodes of liquid crystal cells Clc connected respectively to the TFTs. Each TFT supplies a video signal from a corresponding one of the data lines DL to a corresponding one of the liquid crystal cells Clc in response to a gate pulse from a corresponding one of the gate lines GL.

Each liquid crystal cell Clc can be equivalently expressed as a liquid crystal capacitor because it is provided with a pixel electrode connected to the corresponding TFT, and a common electrode Vcom facing the pixel electrode with a liquid crystal layer interposed therebetween. This liquid crystal cell further includes a storage capacitor Cst for maintaining a video signal charged on the liquid crystal capacitor until a next video signal is charged thereon.

The upper substrate includes at least three color filters including red, green and blue filters, a black matrix for separating the color filters from one another and defining pixel cells, and a common electrode Vcom to which a common voltage is supplied. Here, the common electrode is formed on the upper substrate in a vertical electric field driving mode such as a Twisted Nematic (TN) mode or Vertical Alignment (VA) mode, and on the lower substrate together with the pixel electrode in a horizontal electric field driving mode such as an In-Plane Switching (IPS) mode or Fringe Field Switching (FFS) mode. Polarizing plates whose optical axes are orthogonal to each other are attached on the upper substrate and lower substrate of the liquid crystal panel 102, respectively. Orientation films for setting of a pretilt angle of the liquid crystal are formed on the inner surfaces of the upper substrate and lower substrate contacting the liquid crystal.

Figure 4:
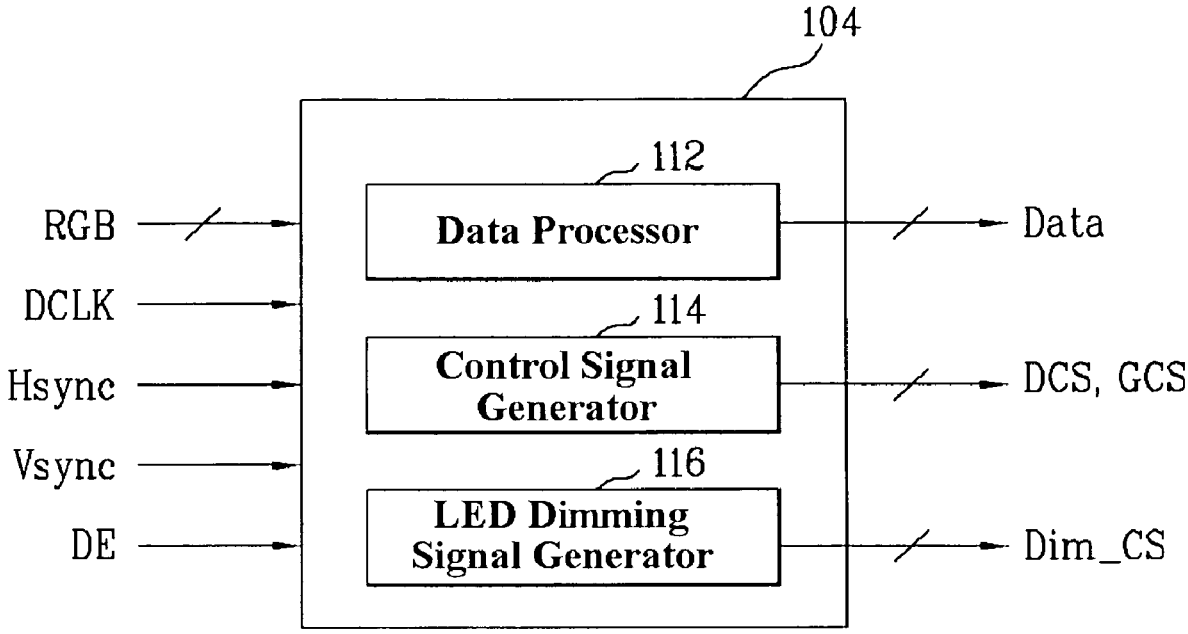
FIG. 4 is a block diagram of a timing controller of the liquid crystal display according to the embodiment of the present invention.

The timing controller 104 includes, as shown in FIG. 4, a data processor 112 for supplying video data R, G and B externally supplied thereto to the data driver 106, a control signal generator 114 for generating data and gate control signals DCS and GCS for control of the data driver 106 and gate driver 108, and an LED dimming signal generator 116 for generating the dimming signals Dim_CS for control of the LED backlight unit 110.

The data processor 112 arranges the externally supplied video data R, G and B into data signals Data suitable for the driving of the liquid crystal panel 102 and supplies the arranged data signals Data to the data driver 106.

The control signal generator 114 generates the data control signals DCS and gate control signals GCS using a main clock DCLK, a data enable signal DE, and horizontal and vertical synchronous signals Hsync and Vsync externally inputted thereto, and applies the generated data control signals DCS and gate control signals GCS to the data driver 106 and gate driver 108, respectively, to control the driving timings thereof. Here, the data control signals DCS include a source start pulse SSP, a source shift clock SSC, a polarity control signal POL and a source output enable signal SOE, and the gate control signals GCS include a gate start pulse GSP, a gate output enable signal GOE, and a plurality of gate shift clocks GSC.

Here, the gate start pulse GSP indicates a start timing which the scanning is started in one vertical period in which one frame is displayed. The gate shift clock signal GSC is a timing control signal which is inputted to a shift register in the gate driver to sequentially shift the gate start pulse GSP. This gate shift clock signal GSC has a pulse width corresponding to an ON period of the TFT. The gate output enable signal GOE enables the output of the gate driver 108.

The source shift clock SSC controls a data latch operation of the data driver 106 on the basis of a rising or falling edge thereof. The source output enable signal SOE enables the output of the data driver 106. The polarity control signal POL controls the polarity of a data voltage to be supplied to each liquid crystal cell Clc of the liquid crystal panel 102.

Also, in order to reduce electromagnetic interference (EMI) and a swing width of a data voltage on a data transfer path when the data voltage is supplied to the data driver 106, the timing controller 104 modulates data in a mini Low-Voltage Differential Signaling (LVDS) manner or Reduced Swing Differential Signaling (RSDS) manner and supplies the modulated data to the data driver 106.

The data driver 106 converts the digital video data R, G and B from the timing controller 104 into positive/negative analog data voltages using positive/negative gamma voltages in response to the data control signals DCS and supplies the converted positive/negative analog data voltages to the data lines DL1 to DLm. At this time, the data driver 106 supplies analog data voltages of video signals of one horizontal line to the data lines DL1 to DLm at intervals of one horizontal period in which each scan signal is supplied to each gate line GL. Here, the data driver 106 may be mounted in a Tape Carrier Package (TCP) or Chip-On-Film (COF) and connected to the liquid crystal panel 102, or may be mounted in the liquid crystal panel 102 in a Chip-On-Glass (COG) manner.

The gate driver 108 sequentially generates and supplies scan pulses, or gate pulses, to the gate lines GL1 to GLn in response to the gate control signals GCS from the timing controller 104. The gate driver 108 outputs the scan pulse having a gate high voltage VGH and a gate low voltage VGL.

The gate driver 108 includes a shift register, a level shifter for converting a swing width of an output signal from the shift register into that suitable to the driving of the TFT of the liquid crystal cell, and an output buffer connected between the level shifter and the gate lines GL1 to GLn. With this configuration, the gate driver 108 sequentially outputs the scan pulses. Here, the gate driver 108 may be mounted in a COF or TCP and connected to gate pads formed on the lower substrate of the liquid crystal panel 102 via an anisotropic conductive film (ACF). Alternatively, the gate driver 108 may be directly formed on the lower substrate of the liquid crystal panel 102 using a Gate-In-Panel (GIP) process, simultaneously with the data lines DL1 to DLm, gate lines GL1 to GLn and TFTs formed in a pixel array. As another alternative, the gate driver 108 may be directly adhered on the lower substrate of the liquid crystal panel 102 in the COG manner.

Figure 5:
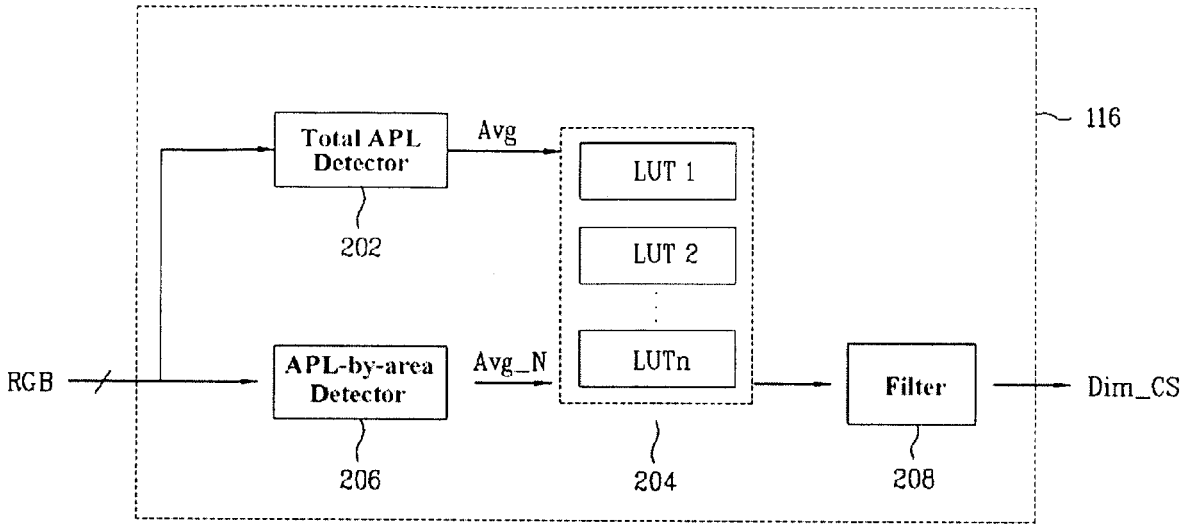
FIG. 5 is a block diagram of an LED dimming signal generator of the liquid crystal display according to the embodiment of the present invention.

The LED dimming signal generator 116 generates a dimming signal appropriate to an image of each video data outputted to the liquid crystal panel 102 using an APL of the externally supplied video data R, G and B and supplies the generated dimming signal to the LED backlight unit 110. To this end, the LED dimming signal generator 116 includes, as shown in FIG. 5, a total APL detector 202 for detecting a total APL of the video data, an APL-by-area detector 206 for detecting an APL of video data supplied to each of the plurality of areas of the liquid crystal panel, and a plurality of lookup tables 204 each for outputting optimum dimming signals Dim_CS based on the total APL and the APL of each area.

The total APL detector 202 detects the total APL Avg of the externally supplied video data R, G and B and supplies it to the plurality of lookup tables 204. In other words, the total APL detector 202 detects the total APL Avg of the externally supplied video data R, G and B on a frame-by-frame basis and supplies it to the lookup tables 204 so that an optimum one of the lookup tables 204 can be selected based on the detected total APL Avg.

The APL-by-area detector 206 detects APLs by the partitioned areas of the liquid crystal panel 102. That is, the APL-by-area detector 206 partitions video data of one frame of the liquid crystal panel 102 into N areas, detects APLs Avg_N by the partitioned areas and supplies the detected APLs Avg_N to the lookup tables 204.

Each of the lookup tables 204 has dimming values of APLs-by-areas with respect to a total APL. That is, dimming values of APLs-by-areas are measured with respect to a total APL by supplying video data R, G and B to the liquid crystal panel 102, and then stored in each of the lookup tables 204. Thereafter, an optimum one of the lookup tables 204 is selected based on the total APL Avg detected by the total APL detector 202 and the APLs Avg_N by areas detected by the APL-by-area detector 206 are then matched with the selected lookup table so that optimum dimming signals Dim_CS by areas can be supplied to the LED backlight unit 110.

The LED dimming signal generator 116 further includes a filter 208 for removing noise from the dimming signals Dim_CS from the lookup tables 204.

The LED backlight unit 110 includes a plurality of LED arrays 118 each including a plurality of LEDs, and an LED controller 120 for turning on the LEDs based on dimming values of the dimming signals Dim_CS.

The LED controller 120 generates PWM control signals LED_PWM corresponding respectively to the dimming values of the dimming signals Dim_CS and supplies the generated PWM control signals LED_PWM respectively to the LED arrays 118 so that optimum light can be supplied to each area according to video data of one frame.

Each of the LED arrays 118 includes a plurality of LEDs installed to correspond to a corresponding one of a plurality of partitioned areas of the rear surface of the liquid crystal panel 102. Each LED of each LED array 118 is turned on in response to a corresponding one of the PWM control signals LED_PWM from the LED controller 120 to irradiate light to the corresponding partitioned area of the rear surface of the liquid crystal panel 102. Here, the LEDs in each LED array 118 can be arranged in the form of a multi chip including a red (R) LED, green (G) LED and blue (B) LED. As a result, each LED array 118 emits white light by mixing red light, green light and blue light generated respectively from the red (R) LED, green (G) LED and blue (B) LED using white balancing.

As described above, the liquid crystal display according to the present embodiment converts input video data RGB into analog video signals and supplies the converted video signals to the respective data lines DL synchronously with the supply of a scan signal to each gate line GL to drive the liquid crystal cells. Also, the liquid crystal display detects a total APL based on the input video data RGB, re-sets a new dimming curve based on the detected total APL to generate dimming signals Dim_CS based on APLs of the respective partitioned areas of the liquid crystal panel 102, and turns on a plurality of LEDs based on each dimming signal Dim_CS to irradiate light to each partitioned area of the liquid crystal panel 102. Therefore, the liquid crystal display according to the present embodiment controls transmittance of light irradiated from the LED backlight unit 110 through the liquid crystal cells driven by the analog video signals to display an image corresponding to the input video data on the liquid crystal panel 102.

Figure 6:
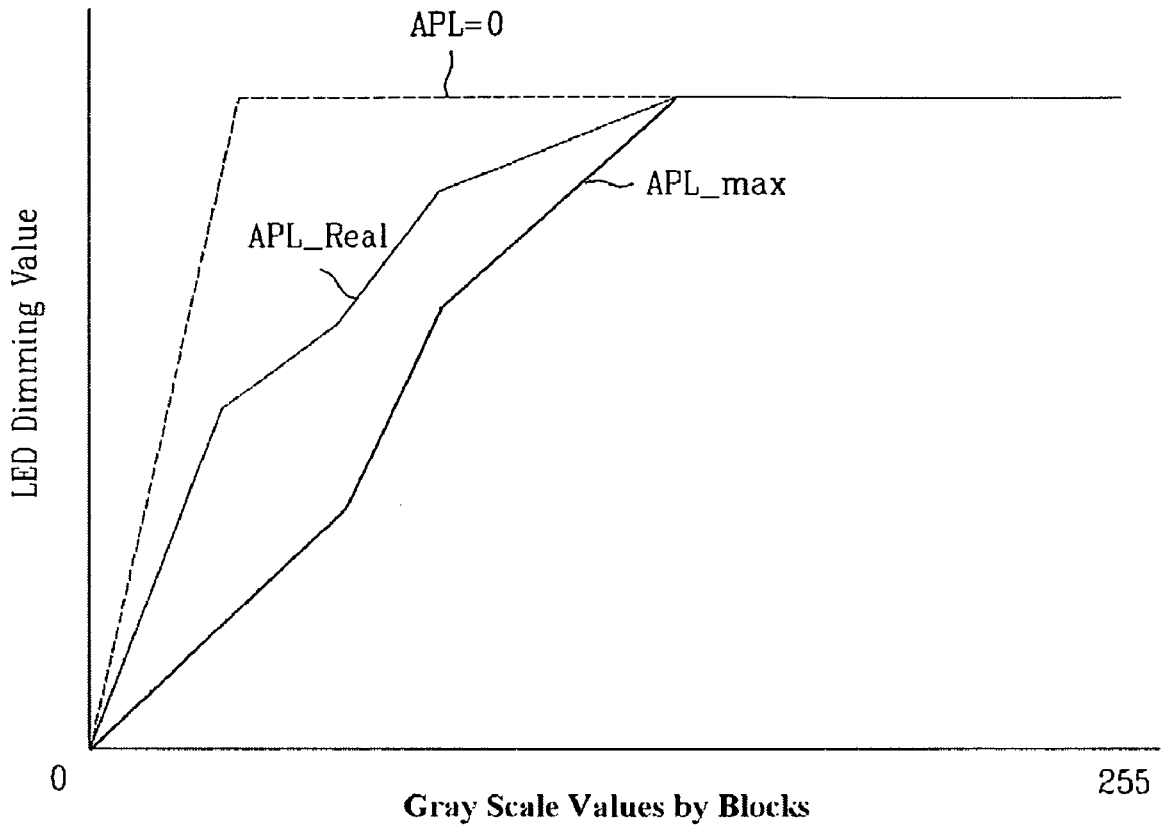
FIG. 6 is a view showing a plurality of dimming curves to be stored in a lookup table of the liquid crystal display according to the embodiment of the present invention.

According to the present invention, in the case where an image having a high APL is inputted, a dimming curve APL_Max is selected to increase a gray scale-based dimming range, as shown in FIG. 6. Therefore, the LED backlight unit 110 is controlled within the increased dimming range, so as to reduce power consumption. For example, when a full white image is inputted, a dimming curve is set to have low dimming values, because the screen is fully bright, and the LED backlight unit 110 is controlled based on the set dimming curve.

Also, in the case where an image having a low APL is inputted, a dimming curve APL0 is selected to control the LED backlight unit 110, so as to reduce a side effect such as screen darkening or flashing.

In other words, the liquid crystal display of the present invention selects one of a plurality of lookup tables based on an APL APL_Real of video data inputted in real time, supplies dimming signals based on APLs by areas detected by the APL-by-area detector, stored in the selected lookup table, to the LED backlight unit and supplies appropriate PWM control signals based on the supplied dimming signals to LED arrays corresponding respectively to a plurality of areas of the liquid crystal panel, so as to reduce a side effect and improve display quality of the liquid crystal display.

In addition, the liquid crystal display of the present invention selects a lookup table having optimum dimming values according to real-time video data supplied to the liquid crystal panel and supplies dimming signals based on the selected lookup table to the LED backlight unit, so as to reduce power consumption.

As apparent from the above description, a liquid crystal display of the present invention selects one of a plurality of lookup tables based on an APL of video data inputted in real time, supplies dimming signals based on APLs by areas detected by an APL-by-area detector, stored in the selected lookup table, to an LED backlight unit and supplies appropriate PWM control signals based on the supplied dimming signals to LED arrays corresponding respectively to a plurality of areas of a liquid crystal panel, so as to reduce a side effect during local LED dimming and improve display quality of the liquid crystal display.

Further, the liquid crystal display of the present invention selects a lookup table having optimum dimming values according to real-time video data supplied to the liquid crystal panel and supplies dimming signals based on the selected lookup table to the LED backlight unit, so as to reduce power consumption.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. A liquid crystal display comprising:

a liquid crystal panel having a plurality of liquid crystal cells formed respectively in a plurality of pixel areas defined by intersections of a plurality of gate lines and a plurality of data lines;

a data driver for supplying data voltages to the data lines;

a gate driver for supplying scan signals to the gate lines;

a timing controller for controlling the data driver and gate driver and outputting a plurality of dimming signals based on an average picture level (APL) detected based on video data supplied to the liquid crystal panel; and a light emitting diode (LED) backlight unit for partitioning the liquid crystal panel into a plurality of areas and supplying appropriate pulse width modulation (PWM) control signals based on the dimming signals to a plurality of LED arrays installed to correspond respectively to the partitioned areas, to supply light to the liquid crystal panel, wherein the timing controller comprises:

a data processor for arranging the video data and supplying the arranged data to the data driver;

a control signal generator for generating data and gate control signals for control of the data driver and gate driver; and an LED dimming signal generator for generating the plurality of dimming signals appropriate respectively to the plurality of areas, wherein the LED dimming signal generator comprises:

a total APL detector for detecting a total APL of the video data;

an APL-by-area detector for detecting APLs-by-areas of the video data supplied to the plurality of areas; and a plurality of lookup tables each for storing dimming values set according to the total APL detected by the total APL detector and the APLs-by-areas detected by the APL-by-area detector and outputting the stored dimming values as the dimming signals, wherein an optimum lookup table of the plurality of lookup tables is selected based on the detected total APL and then the detected APLs-by-areas is matched with the selected lookup table so that optimum dimming signals by areas are supplied to the LED backlight unit.

2. The liquid crystal display according to claim 1, wherein each of the lookup tables stores dimming values measured with respect to a maximum APL and minimum APL of the video data and APLs between the maximum APL and minimum APL.

3. The liquid crystal display according to claim 1, wherein the LED dimming signal generator further comprises a filter for removing noise from the dimming signals from the lookup tables.

4. The liquid crystal display according to claim 1, wherein the LED backlight unit comprises:

the plurality of LED arrays each including a plurality of LEDs corresponding to a corresponding one of the plurality of areas; and an LED controller for outputting the control signals to the plurality of LED arrays, respectively, in response to the plurality of dimming signals to turn on the LED arrays;

an LED controller for outputting the control signals to the plurality of LED arrays, respectively, in response to the plurality of dimming signals to turn on the LED arrays.

* * * * *